US005211551A

United States Patent [19]

Uppal et al.

[11] Patent Number: 5,211,551

[45] Date of Patent: May 18, 1993

[54] MODULAR MOTOR

[75] Inventors: Sohan L. Uppal, Bloomington; Gary Kassen, Chanhassen, both of Minn.

[73] Assignee: Eaton Corporation, Cleveland, Ohio

[21] Appl. No.: 943,269

[22] Filed: Sep. 10, 1992

[51] Int. Cl.[5] ..... F03C 2/08; F04C 2/10

[52] U.S. Cl. ..... 418/61.3

[58] Field of Search ..... 418/61.3

[56] References Cited

U.S. PATENT DOCUMENTS

| | | | |
|---|---|---|---|
| 3,270,681 | 9/1966 | Charlson | 103/130 |
| 3,431,863 | 3/1969 | Waldorff | 103/131 |
| 3,758,242 | 9/1973 | Ohrberg | 418/61.3 |
| 3,871,798 | 3/1975 | Berlich | 418/61.3 |
| 3,895,888 | 7/1975 | Roberts | 418/61.3 |
| 3,901,630 | 8/1975 | Kilmer | 418/59 |
| 3,960,470 | 6/1976 | Kinder | 418/61 |
| 4,232,708 | 11/1980 | Miller | 418/61.3 |
| 4,457,677 | 7/1984 | Todd | 418/61.3 |
| 4,569,644 | 2/1986 | Swedborg | 418/61 |
| 4,631,010 | 12/1986 | Petersen et al. | 418/61.3 |

*Primary Examiner*—Richard A. Bertsch
*Assistant Examiner*—Roland McAndrews
*Attorney, Agent, or Firm*—L. J. Kasper

[57] ABSTRACT

A modular motor assembly (11) is provided for use with a forward bearing package (13), the assembly including an endcap (15), a valve plate (17), a gerotor gear set (19), and a flange member (21), all of which are held together by a plurality of bolts (23). The bolts are located radially inward of O-ring seals (81,83,85), such that the bolts (23) comprise "wet bolts". Any leakage or weepage past the heads (27) of the bolts (23) flows into a sealed cavity (79) defined by the forward bearing package (13). The modular arrangement permits service and repair of the forward package without disassembly of the modular motor, and the smaller bolt circle diameter of the bolts (23) results in greater stiffness of the endcap (15) and flange member (21), thereby reducing deflection of those members, and increasing volumetric efficiency of the modular motor.

9 Claims, 3 Drawing Sheets

MODULAR MOTOR

BACKGROUND OF THE INVENTION

The present invention relates to low speed, high torque gerotor motors, and more particularly, to such motors including a forward bearing package, or a forward brake package, or some other forward package which receives the dogbone (wobble) shaft which transmits the low speed, high torque output from the gerotor gear set.

A typical gerotor motor includes several housing sections disposed axially on opposite ends of a gerotor gear set. In most of the low speed, high torque gerotor motors which are currently in commercial production, the internally-toothed member (ring) is stationary, and the externally-toothed member (star) is disposed within the ring for orbital and rotational movement therein. Typically, such motors are provided with a dogbone (wobble) shaft, which transmits the rotational component of the movement of the star to the output of the device, such as an output shaft which comprises part of the forward package. It should be understood that, as used herein, the term "forward" is used arbitrarily to refer to the end of the device from which the output element extends, the output element typically being an output shaft or, in some cases, a rotatable housing or hub.

In typical gerotor motors of the type described above, the various housing sections are held in tight sealing engagement against the end faces of the gerotor gear set, and more specifically, with the end faces of the gerotor ring, by means of a plurality of bolts extending through one of the housing sections, then through the gerotor ring, and then into threaded engagement with the other housing section. See for example U.S. Pat. No. 3,270,681, assigned to the assignee of the present invention. In some motors, the heads of the bolts would be in engagement with the forward housing section and be in threaded engagement with the rearward housing section (also frequently referred to as the "endcap"), and in other motor designs, the heads of the bolts would be in engagement with the endcap, and would be in threaded engagement with the forward housing section.

In either case, conventional practice has been to provide seals (for example, "O" ring seals) between each adjacent pair of sections of the motor, with the seals being disposed radially inwardly from the bolts. Thus, in such an arrangement, the bolts are referred to as "dry bolts" because they are located radially outwardly of the "wet" region, i.e., the region of the motor within which, hopefully, the hydraulic fluid is retained.

It is also known to locate the bolts radially inwardly from the seals, in which case the bolts are referred to as "wet bolts". However, this has been considered generally less desirable because leakage fluid flowing between the adjacent surfaces of the various sections of the motor can flow into the bolt holes, which are typically somewhat oversized relative to the bolts, with such leakage then flowing axially along the bolts and then, possibly, to the exterior of the motor. As is generally well known to those skilled in the art, such leakage doesn't normally constitute a "flow" of fluid, but instead, typically constitutes a very small amount of fluid, frequently referred to as "weepage" because the fluid "weeps" through any gap or imperfection existing between the bolt head and the adjacent surface against which the bolt head is seated.

One of the primary performance criteria for a low speed, high torque gerotor motor is its volumetric efficiency, i.e., the actual rotational output of the motor as a percentage of the output of the motor which theoretically should occur, for a given flow of fluid through the motor. As is well known to those skilled in the art, the higher the internal (or external) leakage, the lower the volumetric efficiency, and vice-versa. It is also well known to those skilled in the art that volumetric efficiency is substantially reduced with increasing deflection of the various housing sections, axially away from the elements of the gerotor gear set, thus opening up larger leakage paths. It is recognized that one way of reducing deflection of housing sections away from the gerotor gear seat is to locate the bolts further inward radially, thus effectively making the housing sections "stiffer". However, moving the bolts further inward radially typically would result in "wet bolts" which, as was noted previously, is generally considered less desirable.

SUMMARY OF THE INVENTION

Accordingly, it is an object of the present invention to provide an improved low speed, high torque gerotor motor which is capable of having an increased volumetric efficiency.

It is a more specific object of the present invention to provide such an improved motor utilizing wet bolts, wherein the overall motor assembly configuration makes the use of wet bolts more acceptable that it would normally be.

It is a further object of the present invention to provide an improved motor module which can be utilized with a forward package, such as a bearing package or brake package, wherein the forward package can be removed for service or replacement without the necessity of disassembling or even loosening and disturbing the various sections of the main, torque-generating motor module.

The above and other objects of the invention are accomplished by the provision of a modular fluid pressure operated motor assembly adapted for use with a forward package of the type comprising an output member, a housing, means disposed within the housing for rotatably supporting the output member, and seal means disposed between the housing and the output member whereby the housing is adapted to define a sealed cavity. The modular motor assembly comprises housing means defining a fluid inlet port and a fluid outlet port. A fluid pressure displacement means is associated with the housing means of the modular motor assembly and includes an internally-toothed ring assembly and an externally-toothed star member eccentrically disposed within said ring assembly, said ring assembly and said star member having relative orbital and rotational movement. The ring assembly and the star member interengage to define expanding and contracting fluid volume chambers in response to the orbital and rotational movement. A valve means cooperates with the housing means of the modular motor assembly to provide fluid communication between the fluid inlet port and the expanding fluid volume chambers, and between the contracting fluid volume chambers and the fluid outlet port. The assembly further includes means for transmitting the rotational movement to the output member.

The housing means of the modular motor assembly comprises a housing member disposed forwardly of the ring assembly and the star member, and seal means disposed between the ring assembly and the housing member toward the outer periphery of the engagement thereof. A plurality of bolts is included, each having a head end and a threaded end, each of the head ends being disposed in engagement with a forward surface of the housing member. Each bolt extends axially through the housing member, and the ring assembly, and has the threaded ends in engagement with the housing means, at a location rearwardly of the ring assembly. Each of the bolts is disposed radially inwardly of the seal means of the modular motor assembly, whereby fluid leakage between the housing means and the fluid pressure displacement means is adapted to flow forwardly along the bolts and into the sealed cavity defined by the housing of the forward package.

DESCRIPTION OF THE PREFERRED EMBODIMENT

Figure 1:
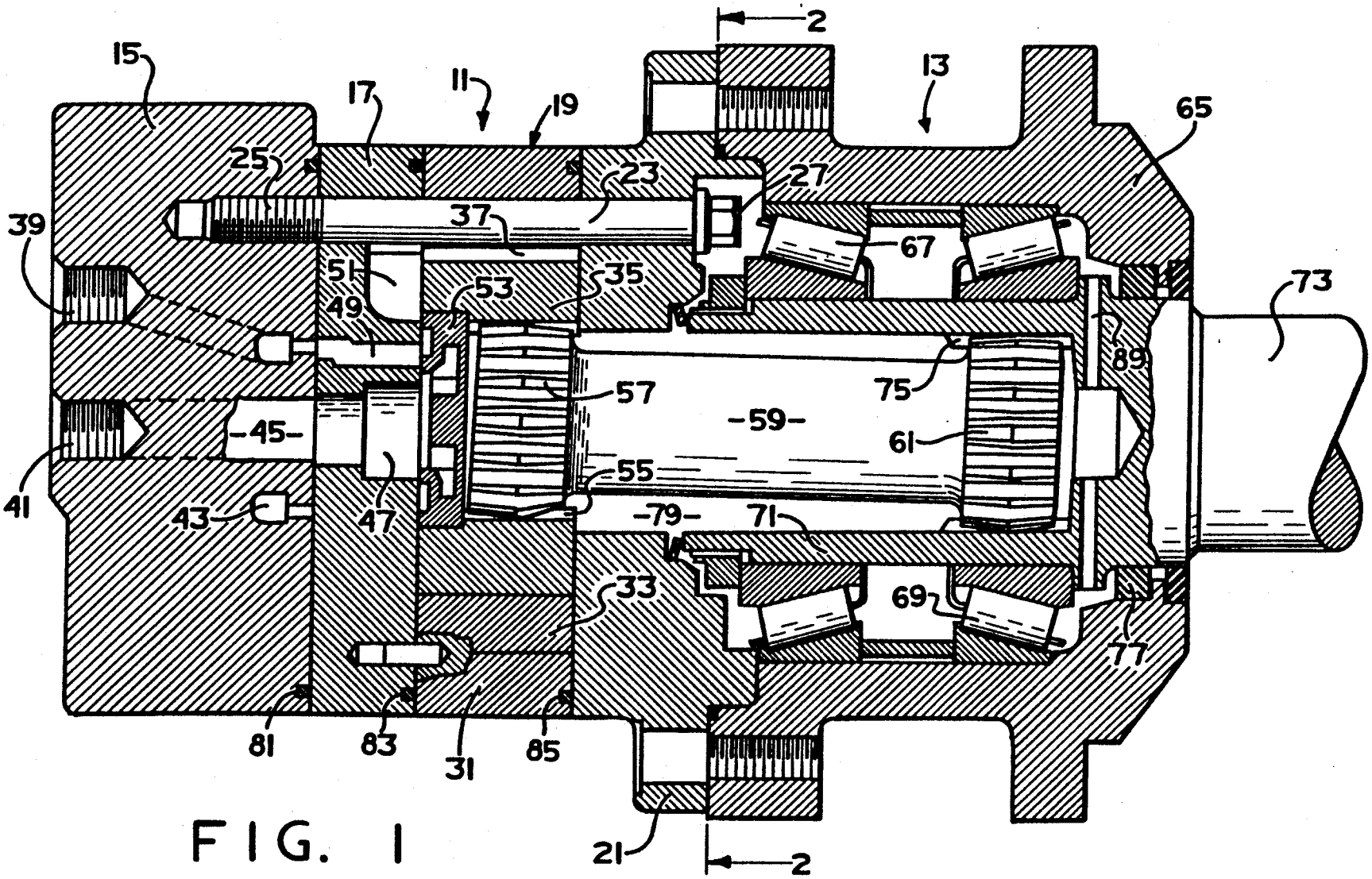
FIG. 1 is an axial cross-section of a low speed, high torque gerotor motor made in accordance with the present invention.

Referring now to the drawings, which are not intended to limit the invention, FIG. 1 illustrates a gerotor motor assembly made in accordance with the present invention. The low speed, high torque gerotor motor shown in FIG. 1 may be of the general type illustrated and described in U.S. Pat. No. 3,862,814, assigned to the assignee of the present invention, and incorporated herein by reference.

More specifically, the gerotor motor shown in FIG. 1 is of the type illustrated and described in U.S. Pat. Nos. 4,715,798; 4,741,681, and 4,976,594, all of which are assigned to the assignee of the present invention and incorporated herein by reference.

Figure 2:
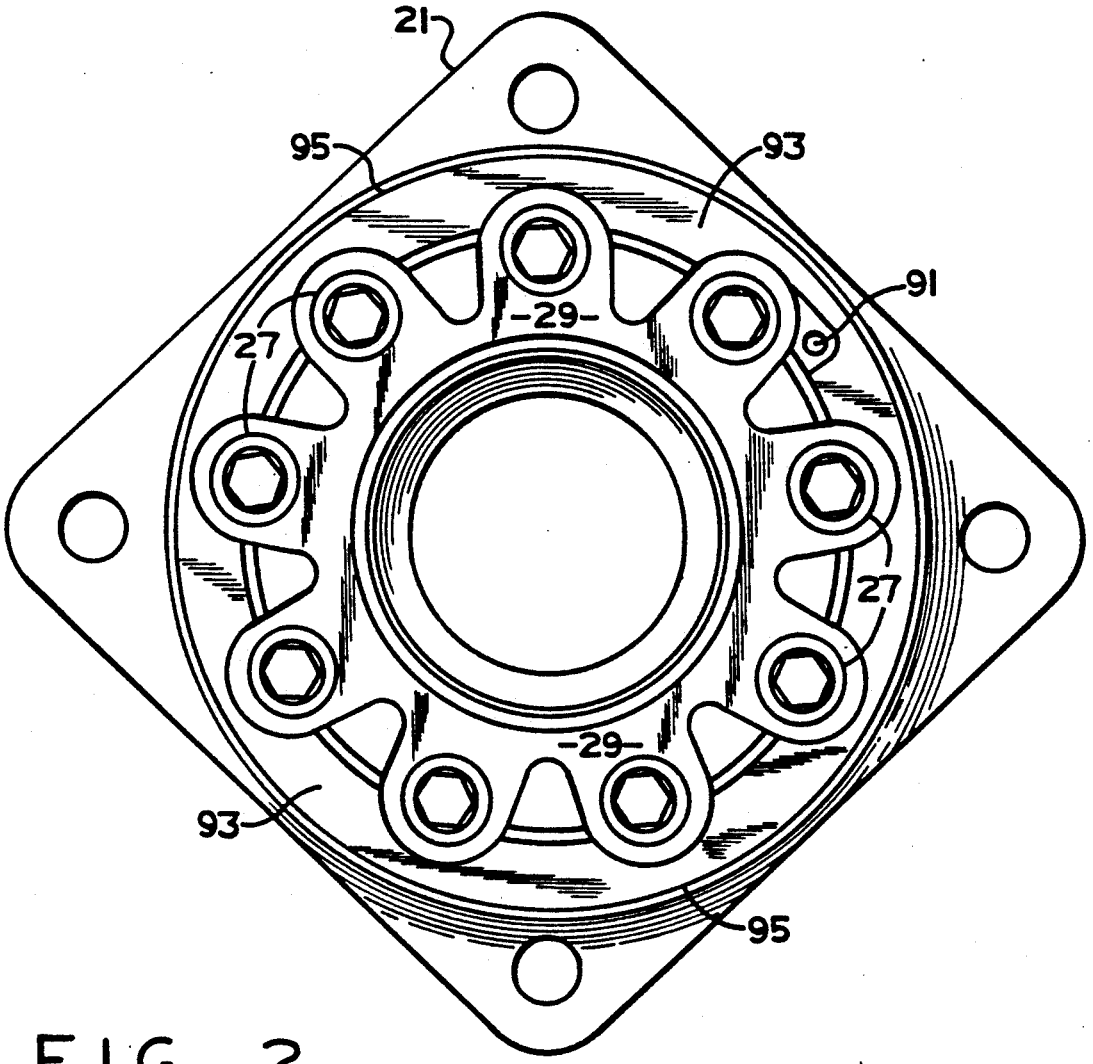
FIG. 2 is a transverse cross-section, taken generally on line 2—2 of FIG. 1, and on a slightly larger scale, showing a front plan view of the flange member.

The motor assembly shown in FIG. 1 comprises a modular motor assembly, generally designated 11, and a forward bearing package, generally designated 13. The modular motor 11, which will be described only briefly herein in view of above-incorporated U.S. Pat. No. 4,976,594, includes an endcap 15, a stationary valve plate 17, a gerotor gear set, generally designated 19, and a flange member 21. In accordance with one important aspect of the present invention, the elements 15 through 21 are held in tight sealing engagement by means of a plurality of bolts 23 (see also FIGS. 2 and 3). Each of the bolts 23 includes a threaded portion 25, in threaded engagement with an internally threaded bore defined by the endcap 15. Each of the bolts 23 also includes a head 27 disposed in engagement with a forward surface 29, defined by the flange member 21 (see FIG. 3).

The gerotor gear set 19 may be of the type well known in the art, and includes an internally-toothed ring member 31 defining a plurality of generally semi-cylindrical openings, with a cylindrical roller member 33 being disposed in each of the openings, and serving as the internal teeth of the ring member 31. Eccentrically disposed within the ring member 31 is an externally-toothed star member 35, which typically has one less external tooth than the number of the internal teeth 33, thus permitting the star 35 to orbit and rotate relative to the ring 31, as is well known to those skilled in the art. The orbital and rotational movement of the star 35 within the ring 31 defines a plurality of expanding and contracting fluid volume chambers 37.

The endcap 15 defines a fluid inlet port 39 and a fluid outlet port 41, the inlet port 39 being in fluid communication with an annular fluid chamber 43, and the outlet port 41 being in fluid communication with a fluid chamber 45. Those skilled in the art will understand that, in order to reverse the rotational direction of operation of the motor assembly 11, the port 41 can become the inlet port, while the port 39 becomes the outlet port, i.e., the direction of fluid flow through the motor is reversed.

The stationary valve plate 17 defines a central fluid passage 47, in communication with the chamber 45, and a plurality of fluid passages 49, each of which is in communication with the annular fluid chamber 43. The valve plate 17 also defines a plurality of valve passages 51, each of which is in continuous fluid communication with one of the expanding and contracting fluid volume chambers 37. The rearward portion of the star 35 defines a counterbore within which is disposed a valve member 53. The details of the valve member 53 are not an essential feature of the present invention, but are illustrated and described in detail in several of the above-incorporated patents. It is sufficient to note that, as the star 35 orbits and rotates within the ring 31, the valve member 53 achieves commutating fluid communication of high pressure inlet fluid from the inlet port 39 to the expanding volume chambers 37, and commutating fluid communication of low pressure outlet fluid from the contracting fluid volume chambers 37 to the outlet port 41.

The star 35 defines a set of internal splines 55, which are in engagement with a set of external, crowned splines 57 formed on the rearward end of a main drive shaft 59. Disposed at the forward end of the driveshaft 59 is another set of external, crowned splines 61, which will be referred to again subsequently. The main driveshaft 59 is also referred to as a "dogbone" shaft or a "wobble" shaft by those skilled in the art. The function of the shaft 59 is to transmit the rotational component of the movement of the star 35, which also has an orbital component of its movement, and transmit that rotational component to an element of the forward bearing package 13, which has only rotational motion, as will be described subsequently.

Figure 3:
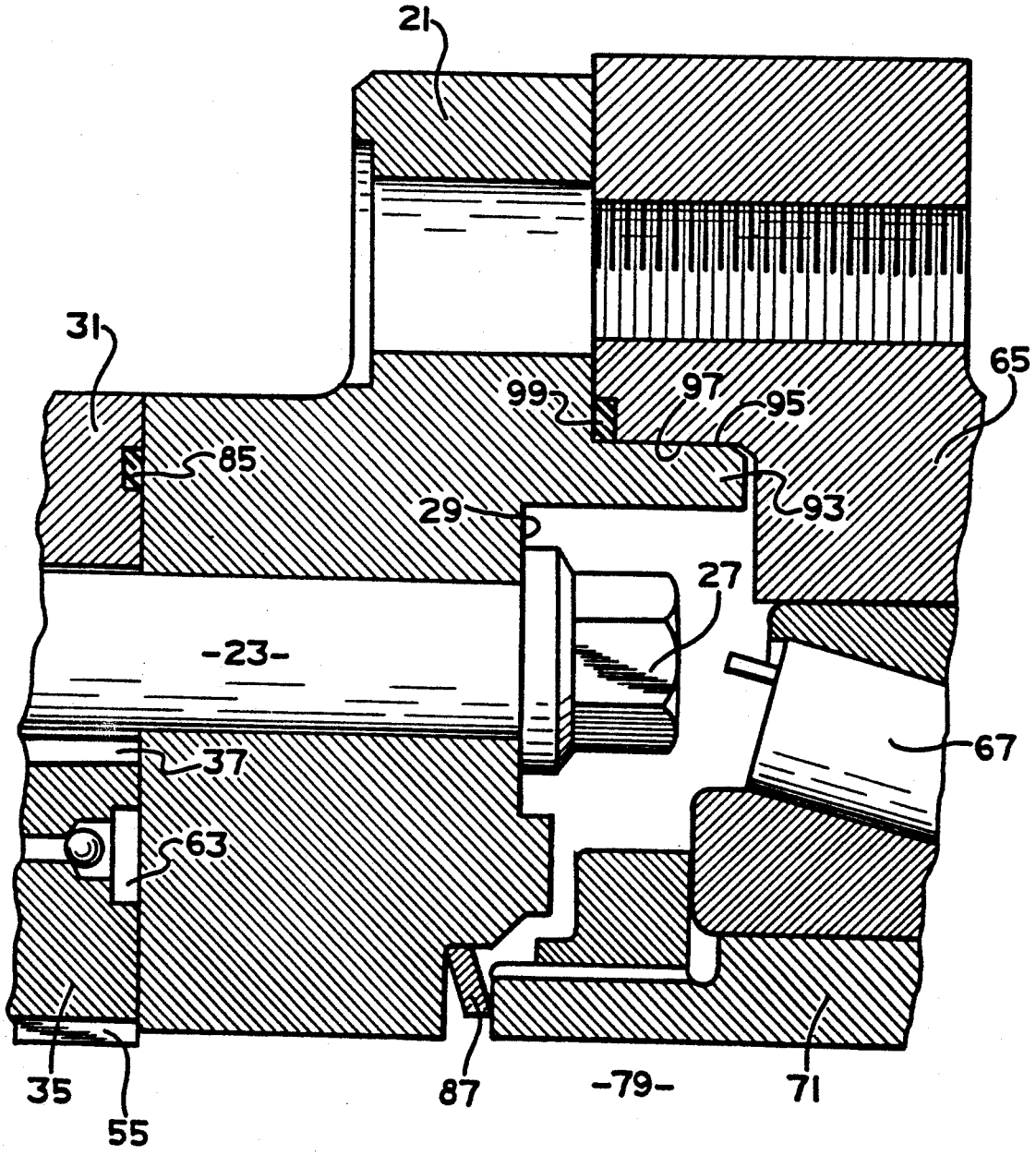
FIG. 3 is an enlarged, fragmentary, axial cross-section, similar to FIG. 1. illustrating one aspect of the present invention in greater detail.

As may be seen only in FIG. 3, the star 35 defines a pressure balancing recess 63, the construction and function of which is illustrated and described in great detail in above-incorporated U.S. Pat. No. 4,976,594. The "modular" and "wet bolt" construction of the present invention is especially advantageous when used in a motor configuration such as that shown herein, for two primary reasons. First, the construction shown in FIG. 1, and in several of the aboveincorporated patents, was developed primarily for use as a "high pressure" motor, wherein the pressure differential between the inlet port and outlet port could be in excess of 4,000 or 5,000 psi, thus making it critically important to reduce deflection of housing sections and increase volumetric efficiency of the motor. Secondly, the inclusion of the pressure balancing feature, as represented by the pressure balancing recess 63, increases the chances for deflection of the flange member 21, away from the gerotor set 19, because the pressure balancing feature involves an annular chamber, disposed between the star 35 and the flange member 21, containing fluid substantially at system pressure.

Referring again to FIG. 1, the forward bearing package 13 defines a bearing housing 65 within which is disposed a pair of tapered, roller bearings 67 and 69. The bearings 67 and 69 support a hollow, generally cylindrical portion 71 of an output shaft 73. The portion 71 defines a set of internal, straight splines 75, which are in splined engagement with the external crowned splines 61, in a known manner. Disposed between the output shaft 73 and the bearing housing 65 is an annular seal assembly 77, such that the output shaft 73 and the housing 65 cooperate to define, in cooperation with the modular motor assembly 11, a sealed cavity 79. Although the subject embodiment shows the forward bearing package 13 having a shaft as its output, it should be understood that within the scope of the invention, the "output member" of the forward package could be a rotating wheel hub, or a wheel flange, or any one of a number of outputs, other than a shaft.

Referring still primarily to FIG. 1, there is an O-ring seal 81 disposed between the endcap 15 and the stationary valve plate 17; there is an O-ring seal 83 disposed between the valve plate 17 and the ring member 31; and there is an O-ring seal 85 disposed between the ring member 31 and the flange 21 (see also FIG. 3). In accordance with the explanation in the Background of the Disclosure, the location of the bolts 23 radially inwardly from the O-ring seals 81, 83, and 85 results in the bolts 23 being considered "wet bolts". However, because the head 27 of each of the bolts 23 is in tight engagement with the adjacent forward surface 29, the fact that the bolts 23 are "wet bolts" does not necessarily imply that there will be a steady flow of leakage flowing along the bolts 23 and past the heads 27. Instead, there may be a small amount of leakage, of the type frequently referred to as "weepage", which may comprise nothing more than several drops of fluid, periodically, and even this weepage typically occurs at only a relatively small percentage of motor bolts. However, for simplicity, the term "leakage" will be utilized hereinafter, it being understood that the term "leakage" is broad enough to encompass either true leakage flow, or weepage of the type described previously. However, those skilled in the art will understand that even such a small amount of fluid would be undesirable in a conventional motor in which the heads of the bolts were disposed against an exterior surface of the motor, such that the leakage or "weepage" would be visible on the outside of the motor. Therefore, in accordance with one important aspect of the present invention, any leakage or weepage at the heads 27 would typically flow radially inwardly between the bearing set 67 and the flange 21, past a seal member 87 (see FIG. 3), and into the sealed cavity 79.

Referring again primarily to FIG. 1, the output shaft 73 defines a pair of radial passages 89 which provide fluid communication between the sealed cavity 79 and the chamber surrounding the cylindrical portion 71. As may best be seen in FIG. 2, the flange member 21 defines an axially-extending case drain passage 91, which typically would also extend axially through the ring member 31, the valve plate 17, and at least partway through the endcap 15. Although not directly related to the invention, and not an essential feature of the invention, the several most likely lubricant arrangements usable with the present invention will be described. As one alternative, the lubricant path could flow "clockwise", i.e., case drain flow could be to the right in FIG. 1 through the passage 91, joining any leakage past the bolt heads 27, and from there flowing first through the bearing 67, then through the bearing 69, then radially inwardly through the passages 89, into the sealed cavity 79. The lubricant fluid then flows axially through the splines 61, then radially outward through the flange member 21 through a passage not shown in FIG. 1, and then to the low pressure side of the motor through passage means also not shown in FIG. 1.

As a second alternative, the lubricant (leakage) flow can be counterclockwise, i.e., just the opposite of that described above. In this alternative, lubricant flows through a passage in the flange member 21 (not shown herein) then through the splines 61, then radially outwardly through the passages 89, and then through bearing 69 and bearing 67. The lubricant is then joined by any leakage past the bolt heads 27, and the fluid then flows through the case drain passage 91 axially to the left in FIG. 1, then to the low pressure side of the motor.

Referring again to FIG. 3, another aspect of the present invention will be described. The flange member 21 defines an annular portion 93 extending forwardly (to the right in FIGS. 1 and 3), which defines a cylindrical pilot surface 95. The pilot surface 95 is in engagement with a mating, generally cylindrical internal surface 97 defined by the bearing housing 65. An O-ring seal 99 is disposed between the surfaces 95 and 97, to provide a fluid tight seal therebetween. Therefore, it is also an important aspect of the present invention that the bolts 23, in addition to being "wet bolts", be disposed radially inwardly of the pilot surface 95 and the internal surface 97, which comprise the point of engagement of the modular motor assembly 11 and the forward bearing package 13.

Thus, it may be seen that the modular motor assembly 11, made in accordance with the present invention, provides a number of benefits:

1. The modular construction makes it possible to service or repair the forward package without disassembling or in any way loosening or disturbing the main, torque-generating portion of the device, i.e., the motor assembly 11;

2. The modular construction makes it possible to inventory a number of different forward packages (bearing, brake, etc.) for use with a particular modular motor;

3. The use of the wet bolts, with the bolts being located further radially inwardly, makes the overall motor assembly smaller, lighter, and substantially less expensive to manufacture; and 4. By reducing the bolt circle diameter of the bolts 23, the stiffness of the flange member 21 and the endcap 15 are substantially increased, thus reducing the deflection of those members, and increasing the volumetric efficiency of the motor.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A modular fluid pressure operated motor assembly adapted for use with a forward package of the type comprising an output member, a housing, means disposed within said housing for rotatably supporting said output member relative thereto, and seal means disposed between said housing and said output member, whereby said housing is adapted to define a sealed cavity; said modular motor assembly comprising housing means defining a fluid inlet port and a fluid outlet port; fluid pressure displacement means associated with said housing means and including an internally-toothed ring assembly and an externally-toothed star member eccentrically disposed within said ring assembly, said ring assembly and said star member having relative orbital and rotational movement, said ring assembly and said star member interengaging to define expanding and contracting fluid volume chambers in response to said orbital and rotational movement; valve means cooperating with said housing means to provide fluid communication between said fluid inlet port and said expanding fluid volume chambers, and between said contracting fluid volume chambers and said fluid outlet port; means for transmitting said rotational movement to said output member; said housing means comprising a housing member disposed forwardly of said ring assembly and said star member and seal means disposed between said ring assembly and said housing member toward the outer periphery of the engagement thereof; a plurality of bolts, each having a head end and a threaded end, each of said head ends being disposed in engagement with a forward surface of said housing member, each bolt extending axially through said housing member and said ring assembly, and having said threaded end in threaded engagement with said housing means, at a location rearwardly of said ring assembly, each of said bolts being disposed radially inwardly of said seal means of said modular motor assembly, whereby fluid leakage between said housing means and said fluid pressure displacement means is adapted to flow forwardly along said bolts and into said sealed cavity defined by said housing of said forward package.

2. A modular motor assembly as claimed in claim 1, characterized by said housing means comprising an endcap member, and said threaded ends of said bolts being in threaded engagement with said endcap member.

3. A modular motor assembly as claimed in claim 1, characterized by said housing member cooperating with said star member to define a fluid pressure balancing chamber, fluid pressure in said balancing chamber tending to deflect at least a central portion of said housing member axially forwardly, thus tending to increase fluid leakage between said star member and said housing member.

4. A modular motor assembly as claimed in claim 1, characterized by said housing member defining a generally cylindrical pilot surface disposed radially outwardly of said bolts, said housing of said forward package defining a mating, generally cylindrical internal surface; and seal means disposed between said housing member and said housing of said forward package, radially outwardly of said bolts.

5. A modular motor assembly as claimed in claim 1, characterized by said forward package comprises a forward bearing package, and said means disposed within said housing for rotatably supporting said output member relative to said housing comprises at least one bearing set.

6. A modular motor assembly as claimed in claim 5, characterized by said output member comprising an output shaft, and said means for rotatably supporting said output member comprises a pair of bearing sets axially spaced-apart along said output shaft, and disposed radially between said output shaft and said housing.

7. A modular fluid pressure operated motor assembly adapted for use with a forward package of the type comprising an output member, a housing, means disposed within said housing for rotatably supporting said output member relative thereto, and seal means disposed between said housing and said output member, whereby said housing is adapted to define a sealed cavity; said modular motor assembly comprising housing means defining a fluid inlet port and a fluid outlet port; fluid pressure displacement means associated with said housing means and including an internally-toothed ring assembly and an externally-toothed star member eccentrically disposed within said ring assembly, said ring assembly and said star member having relative orbital and rotational movement, said ring assembly and said star member interengaging to define expanding and contracting fluid volume chambers in response to said orbital and rotational movement; valve means cooperating with said housing means to provide fluid communication between said fluid inlet port and said expanding fluid volume chambers, and between said contracting fluid volume chambers and said fluid outlet port; means for transmitting said rotational movement to said output member; said housing means comprising a housing member disposed forwardly of, and immediately adjacent said ring assembly and said star member, said housing member defining a generally cylindrical pilot surface, and said housing of said forward package defining a mating, generally cylindrical internal surface; a plurality of bolts, each having a head end and a threaded end, each of said head ends being disposed in engagement with a forward surface of said housing member, each bolt extending axially through said housing member and said ring assembly, and having said threaded end in threaded engagement with said housing means, at a location rearwardly of said ring assembly, each of said bolts being disposed radially inwardly of said pilot surface and said cylindrical internal surface, whereby fluid leakage between said housing means and said fluid pressure displacement means is adapted to flow forwardly along said bolts, and into said sealed cavity defined by said housing of said forward package.

8. A modular motor assembly as claimed in claim 7, characterized by seal means disposed between said housing member and said housing of said forward package, radially outwardly of said pilot surface and said cylindrical surface.

9. A modular motor assembly as claimed in claim 7, characterized by said forward package comprising a forward bearing package, said output member comprising an output shaft, and said means for rotatably supporting said output member comprising a pair of bearing sets disposed radially between said output shaft and said housing.

* * * * *